US011332799B2

(12) United States Patent
Ando et al.

(10) Patent No.: US 11,332,799 B2
(45) Date of Patent: May 17, 2022

(54) CASE HARDENING STEEL, METHOD OF PRODUCING THE SAME, AND METHOD OF PRODUCING GEAR PARTS

(71) Applicant: JFE STEEL CORPORATION, Tokyo (JP)

(72) Inventors: Keisuke Ando, Tokyo (JP); Takashi Iwamoto, Tokyo (JP); Kimihiro Nishimura, Tokyo (JP); Katsuyuki Ichimiya, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 446 days.

(21) Appl. No.: 16/330,857

(22) PCT Filed: Sep. 8, 2017

(86) PCT No.: PCT/JP2017/032544
§ 371 (c)(1),
(2) Date: Mar. 6, 2019

(87) PCT Pub. No.: WO2018/047955
PCT Pub. Date: Mar. 15, 2018

(65) Prior Publication Data

US 2019/0218633 A1 Jul. 18, 2019

(30) Foreign Application Priority Data

Sep. 9, 2016 (JP) ..... JP2016-176918

(51) Int. Cl.
*C21D 1/06* (2006.01)
*C21D 9/32* (2006.01)
(Continued)

(52) U.S. Cl.
CPC ..... *C21D 1/06* (2013.01); *C21D 8/065* (2013.01); *C21D 9/0075* (2013.01); *C21D 9/32* (2013.01);
(Continued)

(58) Field of Classification Search
CPC ..... C22C 38/001; C22C 38/002; C22C 38/02; C22C 38/04; C22C 38/22; C22C 38/28; C22C 38/32; C22C 38/26
(Continued)

(56) References Cited

U.S. PATENT DOCUMENTS

| | | | |
|---|---|---|---|
| 9,115,415 | B2 | 8/2015 | Okamoto et al. |
| 2012/0018063 | A1 | 1/2012 | Hashimura et al. |
| 2016/0060744 | A1 | 3/2016 | Kubota et al. |

FOREIGN PATENT DOCUMENTS

| | | | |
|---|---|---|---|
| CN | 102378822 | A | 3/2012 |
| CN | 103124801 | A | 5/2013 |

(Continued)

OTHER PUBLICATIONS

Neishi et al., JP 2005023360 A, machine translation, Jan. 27, 2005, entire translation (Year: 2005).*

(Continued)

*Primary Examiner* — Humera N. Sheikh
*Assistant Examiner* — Katherine A Christy
(74) *Attorney, Agent, or Firm* — Kenja IP Law PC

(57) ABSTRACT

Disclosed are a case hardened steel which is suitable as a material for producing mechanical structural parts having high rotating bending fatigue strength and impact fatigue strength at a relatively low cost, and a method of producing the same. The case hardening steel has a chemical composition containing, by mass %, C, Si, Mn, P, S, Cr, Mo, B, Ti, N, and O within a range satisfying a predetermined relationship, and Al in at least a predetermined amount in
(Continued)

relation to the B, N, and Ti contents, with the balance being Fe and inevitable impurities, wherein $\sqrt{I} \leq 80$ is satisfied, where I represents an area in $\mu m^2$ of an oxide-based inclusion located at the center of a fish-eye on a fracture surface of the case hardening steel after being subjected to carburizing-quenching and tempering and subsequently to a rotating bending fatigue test.

10 Claims, 2 Drawing Sheets

(51) Int. Cl.

| | |
|---|---|
| ***C22C 38/00*** | (2006.01) |
| ***C21D 9/00*** | (2006.01) |
| ***C21D 8/06*** | (2006.01) |
| ***C22C 38/02*** | (2006.01) |
| ***C22C 38/04*** | (2006.01) |
| ***C22C 38/22*** | (2006.01) |
| ***C22C 38/28*** | (2006.01) |
| ***C22C 38/32*** | (2006.01) |
| ***C22C 38/26*** | (2006.01) |
| ***C22C 38/60*** | (2006.01) |
| ***C22C 38/44*** | (2006.01) |
| ***C22C 38/24*** | (2006.01) |
| ***C22C 38/54*** | (2006.01) |
| ***C22C 38/50*** | (2006.01) |
| ***C22C 38/06*** | (2006.01) |
| *C22C 38/20* | (2006.01) |

(52) U.S. Cl.
CPC ..... *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/22* (2013.01); *C22C 38/24* (2013.01); *C22C 38/28* (2013.01); *C22C 38/32* (2013.01); *C22C 38/44* (2013.01); *C22C 38/50* (2013.01); *C22C 38/54* (2013.01); *C22C 38/60* (2013.01); *C22C 38/20* (2013.01); *C22C 38/26* (2013.01)

(58) Field of Classification Search
USPC ..... 428/544
See application file for complete search history.

(56) References Cited

FOREIGN PATENT DOCUMENTS

| | | | | |
|---|---|---|---|---|
| CN | 102770570 | B | | 4/2015 |
| EP | 2530178 | A1 | | 12/2012 |
| JP | H07100840 | B2 | | 11/1995 |
| JP | 3094856 | B2 | | 10/2000 |
| JP | 2000273574 | A | | 10/2000 |
| JP | 3319648 | B2 | | 9/2002 |
| JP | 3329177 | B2 | | 9/2002 |
| JP | 2005023360 | A | * | 1/2005 |
| JP | 2005023360 | A | | 1/2005 |
| JP | 3733504 | B2 | | 1/2006 |
| JP | 2007332438 | A | | 12/2007 |
| JP | 2010229508 | A | | 10/2010 |
| JP | 2010248630 | A | | 11/2010 |
| JP | 2011063886 | A | | 3/2011 |
| JP | 2016204752 | A | | 12/2016 |
| KR | 1020150038649 | A | | 4/2015 |
| KR | 1020150126699 | A | | 11/2015 |

OTHER PUBLICATIONS

Dec. 5, 2017, International Search Report issued in the International Patent Application No. PCT/JP2017/032544.

Aug. 6, 2020, Office Action issued by the Korean Intellectual Property Office in the corresponding Korean Patent Application No. 10-2019-7009743 with English language concise statement of relevance.

May 26, 2020, Office Action issued by the China National Intellectual Property Administration in the corresponding Chinese Patent Application No. 201780054506.2 with English language search report.

* cited by examiner

CASE HARDENING STEEL, METHOD OF PRODUCING THE SAME, AND METHOD OF PRODUCING GEAR PARTS

TECHNICAL FIELD

This disclosure relates to a case hardening steel used as a material of parts for machine structural parts such as automobiles and various industrial machines, a method of producing the same, and a method of producing gear parts. In particular, this disclosure relates to a case hardening steel suitable as a material of machine structural parts having high rotating bending fatigue strength and impact fatigue strength, and a method of producing the same.

BACKGROUND

In recent years, gears used in drive transmission parts of machine structural parts such as automobiles are required to be miniaturized as the weight of the vehicle body is reduced for energy saving, and on the other hand are subject to increased load due to higher output of engines. Therefore, improvement of durability of such gears is an issue.

In general, the durability of gears is determined by the impact fatigue fracture of the gear tooth, the rotating bending fatigue fracture of the gear tooth root, and the pitting fatigue fracture of the gear tooth surface. In particular, in a differential gear of an automobile or the like subject to which impact stress is applied, fracture may occur prematurely due to high impact load. Consequently, studies have been conducted on techniques for improving the impact fatigue strength of the case hardening steel as a material.

JPH7100840B (PTL 1) describes improving the impact characteristics by adding Mo to improve the toughness of a carburized layer, reducing Mn, Cr, and P which would lower the grain boundary strength of the carburized layer, setting the lower limit of the value obtained by Mo/(10 Si+100 P+Mn+Cr), and defining the range of the case depth hardened by carburizing treatment.

JP3094856B (PTL 2) describes improving the toughness of a gear by controlling the cooling rate range for quenching appropriately according to the chemical composition such that the gear has a mixed structure of martensite and bainite in its interior.

JP3329177B (PTL 3) describes suppressing the decrease in internal hardness by specifying, as in PTL 2, a microstructure so as to be a mixed structure of martensite and troostite for improving the internal toughness, specifying the ranges of the added amount of Mn and Cr, and adjusting the added amount of Mo to limit the amount of troostite.

JP3733504B (PTL 4) proposes a steel in which Mo is added to the chemical composition described in PTL 3. JP3319648B (PTL 5) proposes a steel material for a bevel gear in which the amounts of Mn, Cr, and Mo added in combination are limited in the component composition such that the hardness of the steel material is suppressed and the impact property is improved without impairing the cold forgeability.

CITATION LIST

Patent Literature

PTL 1: JPH7100840B
PTL 2: JP3094856B
PTL 3: JP3329177B
PTL 4: JP3733504B
PTL 5: JP3319648B

SUMMARY

Technical Problem

However, according to the method described in PTL 1, even if the impact property can be improved, it is necessary either to add a large amount of an expensive alloy Mo or to significantly prolong the carburizing time when Mo is not added much, which leads to a significant increase in product cost or manufacturing cost.

In the method described in PTL 2, since a bainite phase is present in the microstructure, it is possible to increase the impact value by increasing the toughness. However, when a bainite phase is present in the interior of the steel, the internal hardness decreases, and the gear is easily deformed by impact, and the steel may be damaged upon repeated exposure to impact force.

According to the method described in PTL 3, since the amounts of Mn and Cr added in combination is specified and the added amount of Mo is adjusted, grain boundary oxidation increases in the vicinity of the surface layer and oxides of Mn and Cr are formed, with the result that the quench hardenability deteriorates and an incompletely-quenched layer is formed on the surface layer. Accordingly, even if the internal hardness is secured, a fracture from the surface layer is likely to occur due to a decrease in the hardness of the surface layer, and as a result, overall fatigue strength including impact fatigue strength decreases.

In the case of the method described in JP3733504B (PTL 4), if Mo is added, the internal hardness of the gear decreases due to the troostite. Accordingly, if the impact property improves, the fatigue strength such as bending fatigue strength deteriorates as a result of internal factors. In the method described in PTL 5, when a gear is formed by hot forging, the hardness is low and the fatigue strength other than impact fatigue strength is lowered.

It would thus be helpful to provide a case hardening steel suitable as a material for producing mechanical structural parts having high rotating bending fatigue strength and high impact fatigue strength at a relatively low cost, and a method of producing the same.

Solution to Problem

To solve the above problems, the inventors conducted intensive studies on the effects of components, various properties after carburizing, and inclusions on the fatigue resistance after carburizing-quenching and tempering. As a result, we have found the following (A) to (C).

(A) With respect to the grain boundary oxidation layer which can be a crack starting point of impact fatigue and bending fatigue, by adding Si, Mn, Cr, and Mo in a predetermined amount or more, the direction in which the grain boundary oxidation layer grows changes from the depth direction to the surface direction in which the density increases. Accordingly, there will be no such oxide layer that grows in the depth direction as a starting point, and the starting point of fatigue cracks hardly occurs.

(B) As stated in the above (A), Si, Mn, Cr, and Mo are effective for controlling the grain boundary oxidation layer. On the other hand, when added excessively, the amount of retained austenite increases, facilitating the formation of fatigue cracks. It is thus necessary to strictly control the content of Si, Mn, Cr, and Mo.

(C) To ensure that the content of solute B contributing to grain boundary strengthening be 3 ppm or more which is effective for quench hardenability, the content of each element is strictly determined based on the chemical equilibrium of Ti—Al—B—N in the steel.

The present disclosure is based on the above discoveries and the primary features thereof are as follows.

[1] A case hardening steel comprising a chemical composition containing (consisting of), by mass %, C: 0.15% or more and 0.30% or less, Si: 0.50% or more and 1.50% or less, Mn: 0.20% or more and 0.80% or less, P: 0.003% or more and 0.020% or less, S: 0.005% or more and 0.050% or less, Cr: 0.30% or more and 1.20% or less, Mo: 0.03% or more and 0.30% or less, B: 0.0005% or more and 0.0050% or less, Ti: 0.002% or more and less than 0.050%, N: 0.0020% or more and 0.0150% or less, and O: 0.0003% or more and 0.0025% or less, within a range satisfying Expression (1):

$$1.8*[\%\ Si]+1.5*[\%\ Mo]-([\%\ Mn]+[\%\ Cr])/2\geq 0.50 \quad (1),$$

and Al in an amount satisfying the following relations: if $[\%\ B]-[(10.8/14)*\{[\%\ N]-(14/48)[\%\ Ti]\}]\geq 0.0003\%$, then $0.010\%\leq[\%\ Al]\leq 0.100\%$, and if $[\%\ B]-[(10.8/14)*\{[\%\ N]-(14/48)[\%\ Ti]\}]<0.0003\%$, then $(27/14)*\{[\%\ N]-(14/48)[\%\ Ti]-(14/10.8)[\%\ B]+0.02\}\leq[\%\ Al]\leq 0.100\%$, with the balance being Fe and inevitable impurities, where [% M] represents the content by mass % of M element, wherein the following Expression (2) is satisfied:

$$\sqrt{I}\leq 80 \quad (2)$$

where I represents an area in $\mu m^2$ of an oxide-based inclusion located at the center of a fish-eye on a fracture surface of the case hardening steel after being subjected to carburizing-quenching and tempering and subsequently to a rotating bending fatigue test.

[2] The case hardening steel according to [1], wherein the chemical composition further contains, by mass %, one or more selected from the group consisting of Nb: 0.050% or less, V: 0.050% or less, and Sb: 0.035% or less.

[3] The case hardening steel according to [1] or [2], wherein the chemical composition further contains, by mass %, at least one selected from the group consisting of Cu: 1.0% or less and Ni: 1.0% or less.

[4] The case hardening steel according to any one of [1] to [3], wherein the chemical composition further contains, by mass %, one or more selected from the group consisting of Ca: 0.0050% or less, Sn: 0.50% or less, Se: 0.30% or less, Ta: 0.10% or less, and Hf: 0.10% or less.

[5] A method of producing a case hardening steel, comprising: subjecting a cast steel to hot working by at least one of hot forging or hot rolling with a reduction in area satisfying Expression (3):

$$(S1-S2)/S1\geq 0.960 \quad (3)$$

to thereby obtain a case hardening steel as a steel bar or a wire rod, the cast steel comprising a chemical composition containing (consisting of), by mass %, C: 0.15% or more and 0.30% or less, Si: 0.50% or more and 1.50% or less, Mn: 0.20% or more and 0.80% or less, P: 0.003% or more and 0.020% or less, S: 0.005% or more and 0.050% or less, Cr: 0.30% or more and 1.20% or less, Mo: 0.03% or more and 0.30% or less, B: 0.0005% or more and 0.0050% or less, Ti: 0.002% or more and less than 0.050%, N: 0.0020% or more and 0.0150% or less, and O: 0.0003% or more and 0.0025% or less, within a range satisfying Expression (1):

$$1.8*[\%\ Si]+1.5*[\%\ Mo]-([\%\ Mn]+[\%\ Cr])/2\geq 0.50 \quad (1),$$

and Al in an amount satisfying the following relations: if $[\%\ B]-[(10.8/14)*\{[\%\ N]-(14/48)[\%\ Ti]\}]\geq 0.0003\%$, then $0.010\%\leq[\%\ Al]\leq 0.100\%$, and if $[\%\ B]-[(10.8/14)*\{[\%\ N]-(14/48)[\%\ Ti]\}]<0.0003\%$, then $(27/14)*\{[\%\ N]-(14/48)[\%\ Ti]-(14/10.8)[\%\ B]+0.02\}\leq[\%\ Al]\leq 0.100\%$, with the balance being Fe and inevitable impurities, where [% M] represents the content by mass % of M element, S1 represents a sectional area in $mm^2$ of the cast steel in a cross section orthogonal to a stretching direction in the hot working, and S2 represents a sectional area in $mm^2$ of the steel bar or the wire rod in a cross section orthogonal to the stretching direction in the hot working.

[6] The case hardening steel according to [5], wherein the chemical composition further contains, by mass %, one or more selected from the group consisting of Nb: 0.050% or less, V: 0.050% or less, and Sb: 0.035% or less.

[7] The case hardening steel according to [5] or [6], wherein the chemical composition further contains, by mass %, one or more selected from the group consisting of Cu: 1.0% or less and Ni: 1.0% or less.

[8] The case hardening steel according to any one of [5] to [7], wherein the chemical composition further contains, by mass %, one or more selected from the group consisting of Ca: 0.0050% or less, Sn: 0.50% or less, Se: 0.30% or less, Ta: 0.10% or less, and Hf: 0.10% or less.

[9] A method of producing a gear part, comprising: subjecting the case hardening steel as recited in any one of [1] to [4] to either machining or forging and subsequent machining to give a gear shape; and then subjecting the case hardening steel to carburizing-quenching and tempering to obtain a gear part.

[10] A method of producing a gear part, comprising: in addition to the method steps as recited in any one of [5] to [8], subjecting the case hardening steel to either machining or forging and subsequent machining to give a gear shape; and then subjecting the case hardening steel to carburizing-quenching and tempering to obtain a gear part.

Advantageous Effect

According to the present disclosure, it is possible to provide a case hardening steel suitable as a material for producing mechanical structural parts having high rotating bending fatigue strength and high impact fatigue strength at a relatively low cost, and a method of producing the same. That is, when gears, for example, are produced as mechanical structural parts using the disclosed steel, it is possible to achieve mass production of gears excellent not only in the rotating bending fatigue property of the gear tooth root but also in the impact fatigue property of the gear tooth surface.

DETAILED DESCRIPTION

Figure 1:
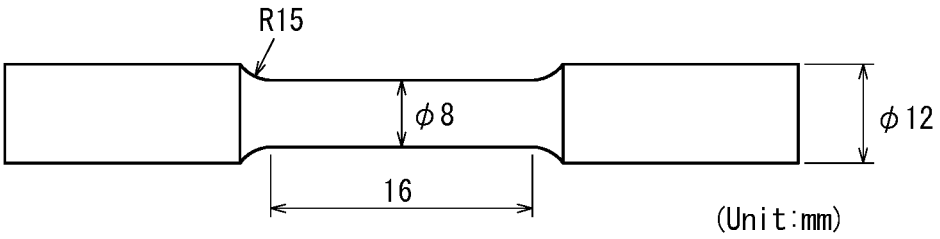
FIG. 1 illustrates a test piece for rotating bending fatigue test.

First, reasons for limiting the chemical composition of the steel to the aforementioned ranges in the present disclosure will be explained. It should be noted that when components are expressed in "%", this refers to mass % unless otherwise specified.

C: 0.15% or more and 0.30% or less

To increase the hardness of the central part by quenching after the carburizing treatment, C content needs to be 0.15% or more. On the other hand, when the content exceeds 0.30%, the toughness of the core part decreases. Therefore, the C content is limited to the range of 0.15% to 0.30%. It is preferably in the range of 0.15% to 0.25%.

Si: 0.50% or more and 1.50% or less

Si is an element that increases temper softening resistance in a temperature range of 200° C. to 300° C. expected to be reached during gearing and the like, and that improves hardenability while suppressing generation of retained austenite which causes reduction in hardness of the carburized surface layer portion. To obtain a steel having this effect, Si content must be at least 0.50%. On the other hand, however, Si is also a ferrite-stabilizing element, and excessive addition raises the $Ac_3$ transformation temperature and ferrite easily appears in the core having a low carbon content in a normal quenching temperature range, resulting in a decrease in strength. In addition, excessive addition inhibits carburization and causes a decrease in hardness of the carburized surface layer portion. In this respect, when the Si content is 1.50% or less, the above adverse effect does not occur. From the above, the Si content is limited to the range of 0.50% to 1.50%. It is preferably in the range of 0.80% to 1.20%.

Mn: 0.20% or more and 0.80% or less

Mn is an element effective for improving the quench hardenability, and Mn content needs to be at least 0.20%. However, Mn tends to form a abnormally carburized layer, and excessive addition leads to decrease in hardness due to an excessive amount of retained austenite. Therefore, the upper limit on the Mn content is set to 0.80%. The Mn content is preferably in the range of 0.30% to 0.60%.

P: 0.003% or more and 0.020% or less

P segregates at the grain boundary and causes deterioration of the toughness of the carburized layer and the inside, and a lower P content is more preferable. Specifically, when the content exceeds 0.020%, the above adverse effect occurs. Therefore, the P content is set to 0.020% or less. On the other hand, the lower limit is set at 0.003% from the viewpoint of production cost.

S: 0.005% or more and 0.050% or less

Since S has an action of forming a sulfide with Mn and improving machinability by cutting, S content is at least 0.005%. On the other hand, excessive addition lowers the fatigue strength and toughness of parts, and thus the upper limit is set at 0.050%. It is preferably in the range of 0.010% to 0.030%.

Cr: 0.30% or more and 1.20% or less

Cr is an element effective for improving the hardenability. However, if the content is less than 0.30%, the effect of adding Cr is poor, whereas if it exceeds 1.20%, an abnormally carburized layer is formed easily. In addition, hardenability becomes too high, and toughness deteriorates and fatigue strength decreases. Therefore, the Cr content is set in the range of 0.30% to 1.20%. It is preferably in the range of 0.40% to 0.80%.

Mo: 0.03% or more and 0.30% or less

Mo is an element for improving hardenability and toughness and having the effect of refining crystal grain size after carburizing treatment. If the content is less than 0.03%, the effect of adding Mo is poor. Therefore, the lower limit is set at 0.03%. On the other hand, when Mo is added in a large amount, the amount of retained austenite becomes excessive, which not only lowers the hardness but also raises the production cost. Therefore, the upper limit is set at 0.30%. From the viewpoint of lowering the amount of retained austenite and manufacturing cost, the upper limit is preferably set at 0.20%.

B: 0.0005% or more and 0.0050% or less

B is an element effective in ensuring quench hardenability when added in a small amount, and the B content needs to be at least 0.0005%. On the other hand, when it exceeds 0.0050%, the addition effect is saturated. Therefore, the B content is set in the range of 0.0005% to 0.0050%. It is preferably in the range of 0.0010% and 0.0040%.

Ti: 0.002% or more and less than 0.050%

Ti is an element that is most likely to bond with N and effective for securing solute B. The Ti content needs to be at least 0.002%. However, when added excessively, a large amount of hard and coarse TiN forms, which serves as a starting point of impact fatigue and bending fatigue fracture, lowering the strength. Since this influence becomes remarkable at 0.050% or more, the Ti content is set in the range of 0.002% to below 0.050%. It is preferably in the range of 0.004% to below 0.025%. It is more preferably in the range of 0.005% to below 0.025%.

N: 0.0020% or more and 0.0150% or less

N is an element that bonds with Al to form AlN, which contributes to the refinement of austenite crystal grains. The N content needs to be at least 0.0020%. However, excessive addition not only makes it difficult to secure solute B but also generates blow holes in the steel ingot at the time of solidification, leading to degradation of forgeability. Therefore, the upper limit is set at 0.0150%. The N content is preferably in the range of 0.0030% to 0.0070%.

O: 0.0003% or more and 0.0025% or less

O is an element that exists as an oxide-based inclusion in the steel and impairs the fatigue strength. Therefore, a lower O content is preferable, yet up to 0.0025% is acceptable. The O content is preferably 0.0015% or less. On the other hand, the lower limit is set at 0.0003% from the viewpoint of production cost.

The Al content is defined as follows in relation to the B, N, and Ti contents.

$$\text{If } [\%\ B]-[(10.8/14)*\{[\%\ N]-(14/48)[\%\ Ti]\}] \geq 0.0003\%,$$

$$\text{then } 0.010\% \leq [\%\ Al] \leq 0.100\%.$$

Al is a necessary element as a deoxidizer, and is also a necessary element to secure solute B in this embodiment. As used herein, $[\%\ B]-[(10.8/14)*\{[\%\ N]-(14/48)[\%\ Ti]\}]$ represents the remainder obtained by subtracting the amount by which B bonds with N stoichiometrically from the B content (hereinafter referred to as the [B] content). When the [B] content is 0.0003% or more, it is possible to secure solute B necessary for improving the quench hardenability. In this case, if the Al content is less than 0.010%, the deoxidation becomes insufficient, and the rotating bending fatigue strength and the impact fatigue strength are deteriorated by oxide-based inclusions. On the other hand, if Al is added in an amount exceeding 0.100%, nozzle clogging occurs during continuous casting and toughness is lowered due to generation of alumina cluster inclusions. Therefore, when the [B] content is 0.0003% or more, the Al content is set in the range of 0.010% to 0.100%.

$$\text{If } [\%\ B]-[(10.8/14)*\{[\%\ N]-(14/48)[\%\ Ti]\}] < 0.0003\%,$$

$$\text{then } (27/14)*\{[\%\ N]-(14/48)[\%\ Ti]-(14/10.8)[\%\ B]+0.02\} \leq [\%\ Al] \leq 0.100\%.$$

On the other hand, if the [B] content calculated from the above expression is less than 0.0003%, it is necessary to increase the amount of Al, which is relatively easy to bond with N, to secure the amount of solute B contributing to the improvement of hardenability. To this end, the Al content is set to (27/14)*{[% N]−(14/48)[% Ti]−(14/10.8)[% B]+0.02} % or more such that the amount of solute B as high as 0.0003% or more that contributes to the improvement of hardenability is secured. The upper limit of the Al content is 0.100%, as in the above case.

In the steel according to the present disclosure, the above-mentioned components are contained, and the balance is Fe and inevitable impurities. However, the following optional components may be added for the purpose of imparting other properties or the like within the range not impairing the action and effect of the disclosure.

Nb: 0.050% or less

Nb is a carbonitride-forming element and contributes to the improvement of surface pressure fatigue strength and impact bending fatigue strength by refining the austenite grain size during carburization. To effectively obtain this effect, when adding Nb, it is preferable to set the Nb content to 0.005% or more. On the other hand, a Nb content exceeding 0.050% may cause deterioration of the ability to suppress grain coarsening and decrease of fatigue strength due to precipitation of coarse NbC. Therefore, the upper limit is preferably set at 0.050%. It is more preferably in the range of 0.005% to below 0.025%.

V: 0.050% or less

V is a carbonitride-forming element like Nb, which contributes to the improvement of fatigue strength by refining the austenite grain size during carburization. It also has the effect of reducing the grain boundary oxidation layer depth. To effectively obtain this effect, when adding V, it is preferable to set the V content to 0.005% or more. On the other hand, the addition effect is saturated at 0.050%, and when added excessively, coarse carbonitrides are produced, and conversely the fatigue strength decreases. Therefore, the upper limit is preferably set at 0.050%. The V content is more preferably in the range of 0.005% to 0.030%.

Sb: 0.035% or less

Sb has a strong tendency of segregating at grain boundaries, and has an effect of suppressing grain boundary oxidation of Si, Mn, Cr, and the like contributing to the improvement of quench hardenability during carburizing treatment, thereby reducing the occurrence of an abnormally carburized layer in the outermost surface layer of the steel and consequently improving the rotating bending fatigue strength and the impact fatigue strength. To effectively obtain this effect, when adding Sb, it is preferable to set the Sb content to 0.003% or more. However, excessive addition not only leads to an increase in cost but also a decrease in toughness. Therefore, the Sb content is preferably set to 0.035% or less. It is more preferably in the range of 0.005% to 0.020%.

Cu: 1.0% or less

Cu is an element contributing to the improvement of quench hardenability and is a useful element which, when added with Se, bonds with Se in the steel and exhibits an effect of preventing coarsening of crystal grains. To obtain these effects, the Cu content is preferably set to 0.01% or more. On the other hand, if the Cu content exceeds 1.0%, the rolled material may have a rough surface skin containing scars. Therefore, the upper limit is preferably set at 1.0%. The Cu content is more preferably in the range of 0.10% to 0.50%.

Ni: 1.0% or less

Ni is an element contributing to the improvement of quench hardenability and is an element useful for improving toughness. To obtain these effects, the Ni content is preferably 0.01% or more. On the other hand, when N is added in an amount exceeding 1.0%, the above effects are saturated. Therefore, the upper limit is preferably set at 1.0%. The N content is more preferably in the range of 0.10% to 0.50%.

Ca: 0.0050% or less

Ca is a useful element for morphological control of sulfides and for improving the machinability by cutting.

To obtain these effects, the Ca content is preferably set to 0.0005% or more. On the other hand, when the Ca content exceeds 0.0050%, not only are the above effects saturated, but also the formation of coarse oxide inclusions is promoted, serving as a starting point of fatigue fracture. Therefore, the upper limit is preferably set at 0.0050%. The Ca content is more preferably in the range of 0.0005% to 0.0020%.

Sn: 0.50% or less

Sn is an element effective for improving the corrosion resistance of the steel material surface. From the viewpoint of improving corrosion resistance, the Sn content is preferably set to 0.003% or more. On the other hand, since excessive addition deteriorates forgeability, the upper limit is preferably set at 0.50%. The Sn content is more preferably in the range of 0.010% to 0.050%.

Se: 0.30% or less

Se bonds with Mn and Cu and disperses as precipitates in the steel. Se precipitates exist stably with little occurrence of precipitate growth in the carburizing heat treatment temperature range, and suppress coarsening of austenite grains by the pinning effect. Therefore, addition of Se is effective for preventing coarsening of crystal grains. To obtain this effect, it is preferable to add at least 0.001% of Se. On the other hand, even if it is added in an amount exceeding 0.30%, the effect of preventing coarsening of crystal grains is saturated. Therefore, the upper limit is preferably set at 0.30%. It is more preferably in the range of 0.005% to 0.100%.

Ta: 0.10% or less

Ta forms carbides in the steel and suppresses coarsening of austenite grains during carburizing heat treatment by the pinning effect. To obtain this effect, it is preferable to add at least 0.003% Ta. On the other hand, if it is added in an amount exceeding 0.10%, cracks are liable to occur at the time of casting and solidification, and scars may remain even after rolling and forging. Therefore, the upper limit is preferably set at 0.10%. The Ta content is more preferably in the range of 0.005% to 0.050%.

Hf: 0.10% or less

Hf forms carbides in the steel and suppresses coarsening of austenite grains during carburizing heat treatment by the pinning effect. To obtain this effect, it is preferable to add at least 0.003% Hf. On the other hand, if it is added in an amount exceeding 0.10%, coarse precipitates are formed at the time of casting and solidification, which may lead to deterioration of the ability to suppress grain coarsening and decrease of fatigue strength. Therefore, the upper limit is preferably set at 0.10%. The Hf content is more preferably in the range of 0.005% to 0.050%.

In the case of the case hardening steel disclosed herein, it is preferable that the balance other than the elements described above consists of Fe and inevitable impurities.

The inventors have found that when a case hardening steel having the above chemical composition satisfies Expression (1) below, the mechanical structural parts produced by subjecting the case hardening steel to carburizing-quenching and tempering have excellent bending fatigue strength and impact fatigue strength that can not be conventionally achieved.

$$1.8*[\%\ Si]+1.5*[\%\ Mo]-([\%\ Mn]+[\%\ Cr])/2\geq 0.50 \quad (1)$$

Where [% M] represents the content by mass % of M element.

The above Expression (1) represents a factor influencing the grain boundary oxidation layer depth, and when the value on the left side is less than 0.50, the effect of reducing grain boundary oxidation layer depth is poor. In this disclosure, by satisfying Expression (1), it is possible to reduce the depth of the grain boundary oxidation layer after the carburizing treatment and the depth of an abnormally carburized layer having low hardness formed therearound, and thus to improve the rotating bending fatigue strength and the impact fatigue strength.

However, it was found that even if each element satisfies Expression (1), in the case where the size of an oxide-based inclusion located on the fracture surface of the test piece after the rotating bending fatigue test is larger than a certain value, the rotating bending fatigue strength and the impact fatigue strength decrease due to such oxide-based inclusions, which results in a problem of premature fatigue fracture. Therefore, it is important for the disclosed case hardening steel to satisfy Expression (2) below after subjection to carburizing-quenching and tempering. The value of the left side $\sqrt{I}$ of Expression (2) is more preferably 60 or less, and even more preferably 40 or less.

$$\sqrt{I}\leq 80 \quad (2)$$

I on the left side of Expression (2) is an index indicating the size of the largest oxide-based inclusion as a starting point of fatigue fracture, and is obtained as follows. Seven test pieces are taken from a case hardening steel (steel bar or wire rod). The test pieces are sampled from a position of half the diameter in parallel to the stretching direction for hot working (that is, the rolling direction in the case of hot rolling or the stretching direction for forging in the case of hot forging), with dimensions of parallel portion diameter 8 mm*parallel portion length 16 mm as illustrated in FIG. 1.

Figure 2:
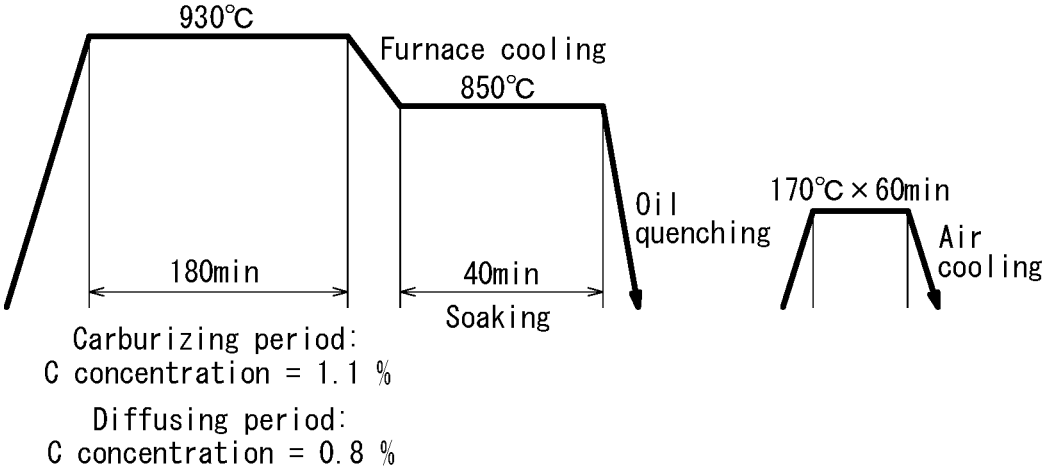
FIG. 2 illustrates heat treatment conditions in carburizing-quenching and tempering treatment.

Carburizing-quenching and tempering are applied to each test piece under the conditions listed in FIG. 2, and then an Ono-type rotary bending fatigue test under completely reversed plane bending is performed to cause a fish-eye fracture. For the test conditions, the surface is polished 0.1 mm after carburizing, the load stress is 1000 MPa, and the rotational speed is 3500 rpm. In a fatigue test conducted with the surface layer polished as described above, internally-initiated fractures are more dominant than surface-layer fractures, that is, the fractures mainly originate from inclusions, and thus fish-eye fractures are observed after the test. The fracture surface of one of the seven test pieces having the minimum fatigue life is observed with a scanning electron microscope, the area of an oxide-based inclusion located at the center of the fish-eye, that is, the area of the largest oxide-based inclusion is measured by image analysis, and the result is expressed as I.

With this method of determining the size of inclusions according to the present disclosure, the size of the largest oxide-based inclusion in the volume of $3.14*(7.8\ mm/2)^2*16\ mm*7=5{,}349\ mm^3$ can be evaluated. In contrast, according to conventional methods of measuring the size, number, or density of oxide inclusions present in a test area, it is impossible to measure the state of oxide-based inclusions in such a large volume, and it is impossible to evaluate inclusions that affect the fatigue life. With the method of evaluating inclusions according to the present disclosure, the size of an oxide-based inclusion which actually became a starting point of fatigue fracture of steel can be evaluated in a volume as large as 5,349 $mm^3$, and the fatigue life prediction accuracy is further improved.

Next, a method of producing a case hardening steel according to the present disclosure will be described.

In order to obtain a case hardened steel which satisfies Expression (2), it is necessary to, in addition to adjusting in the production process the chemical composition of the cast steel to the above ranges including Expression (1), subject the cast steel to hot working by hot forging and/or hot rolling with a reduction in area that satisfies Expression (3), to thereby form a steel bar or a wire rod:

$$(S1-S2)/S1\geq 0.960 \quad (3)$$

Where S1 denotes a sectional area ($mm^2$) of a cast steel in a cross section orthogonal to the stretching direction in the hot working, and S2 denotes a sectional area ($mm^2$) of a steel bar or a wire rod in a cross section orthogonal to the stretching direction in the hot working.

The left side of Expression (3) is an index indicating the reduction in area when the cast steel is subjected to hot working. In this case, the hot working may be hot forging or hot rolling. Further, both hot forging and hot rolling may be performed. When the index indicated by the left side of Expression (3) is less than 0.960, the rotating bending fatigue strength and the impact fatigue strength decrease due to large oxide-based inclusions, resulting in a premature fatigue fracture. More preferably, the left side of Expression (3) is 0.970 or more, and more preferably 0.985 or more. As described above, when a cast steel having a chemical composition according to the present disclosure is subjected to hot working with a reduction in area satisfying Expression (3), a case hardening steel satisfying Expression (2) can be obtained after carburizing-quenching and tempering to be described later.

The case hardening steel (steel bar or wire rod) according to the present disclosure produced as described above is subjected to machining such as cutting or the like with or without hot forging or cold forging performed beforehand, and processed into the shape of the target part (for example, a gear shape). Then, the resultant steel is subjected to carburizing-quenching and tempering to obtain a desired part (for example, a gear). Further, processing such as shot peening may be applied to this part. In addition, when hot forging or cold forging is applied in processing, oxide-based inclusions change in size, yet such change will not proceed in a direction to deteriorate the fatigue life. Therefore, it is still effective to use the case hardening steel according to the disclosure even when it is made into a part by such forging. The conditions for carburizing-quenching and tempering for the case hardening steel are not particularly limited and may be known or arbitrary conditions such as, for example, at a carburizing temperature of 900° C. or higher and 1050° C. or lower for 60 minutes or more and 600 minutes or less, at a quenching temperature of 800° C. or higher and 900° C. or lower for 10 minutes or more and 120 minutes or less, and at a tempering temperature of 120° C. or higher and 250° C. or lower for 30 minutes or more and 180 minutes or less.

EXAMPLES

The structures and function effects according to the disclosure are described in more detail below, by way of examples. However, the case hardening steel is not restricted by any means to these examples, which may be changed appropriately within the range conforming to the purpose of the disclosure, all of such changes being included within the technical scope of the disclosure.

Cast steels having the chemical compositions listed in Table 1 (where the unit of content of each element is mass % and the balance is Fe and inevitable impurities) were hot rolled with a reduction in area listed in Table 2 to obtain round steel bars of different dimensions. Steel Nos. 1 to 29 in Table 1 are conforming steels whose chemical compositions satisfy the requirements of the present disclosure, and Steel Nos. 30 to 52 are comparative steels whose chemical compositions fail to satisfy the requirements of the present disclosure, and Test No. 51 in Table 2 is a comparative example with a reduction in area beyond the limit of the present disclosure.

(Evaluation Method)

For each conforming steel and comparative steel, the following evaluations were made.

(1) Evaluation of Rotating Bending Fatigue Strength and I

Following the above-describe method, seven test pieces were sampled from a position of half the diameter of each of the round steel bars obtained from the conforming steels and comparative steels, and I was determined. Image-Pro_PLUS manufactured by Media-Cybernetics, Inc. was used for image analysis. Table 2 indicates the number of repetitions up to fracture (the minimum fatigue life among the seven) in Ono-type rotary bending fatigue tests under completely reversed plane bending in this procedure. When the minimum fatigue life is 100,000 or more, it can be judged to have excellent rotating bending fatigue strength.

(2) Evaluation of Impact Fatigue Strength

Figure 3:
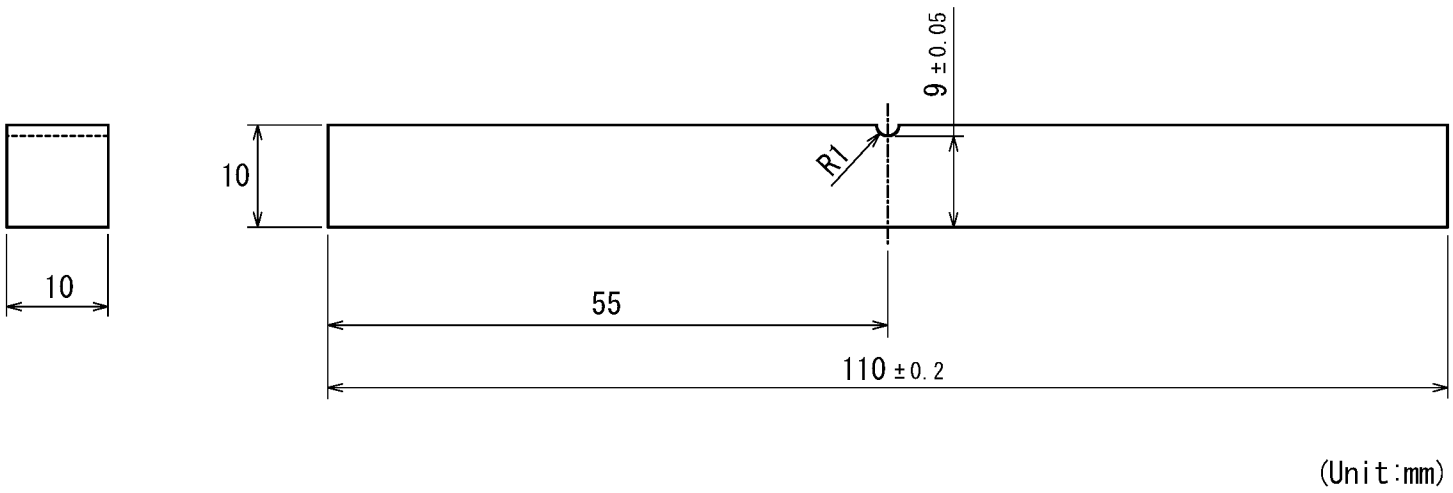
FIG. 3 illustrates a test piece for impact fatigue test.

A test piece of 10*10*110 mm as illustrated in FIG. 3 was sampled from a position of half the diameter of each of the round steel bars obtained from the conforming steels and comparative steels, and used as an impact fatigue test piece. The obtained test piece was subjected to carburizing-quenching and tempering as illustrated in FIG. 2. Then, the impact energy at which a fracture occurred at 1000 repetitions was examined using a falling weight impact tester. In this test, when the impact fatigue strength is 3.5 J or more, it can be judged to have excellent impact fatigue strength. The evaluation results are presented in Table 2.

TABLE 1

| Steel No. | C | Si | Mn | P | S | Cr | Mo | B | [B]*4 | Al lower limit*3 | Al | Ti |
|---|---|---|---|---|---|---|---|---|---|---|---|---|
| 1 | 0.18 | 0.88 | 0.50 | 0.011 | 0.019 | 0.71 | 0.11 | 0.0025 | <0.0003 | 0.038 | 0.045 | 0.006 |
| 2 | 0.21 | 1.02 | 0.42 | 0.010 | 0.015 | 0.54 | 0.15 | 0.0031 | ≥0.0003 | 0.010 | 0.026 | 0.025 |
| 3 | 0.20 | 0.74 | 0.66 | 0.019 | 0.020 | 0.43 | 0.18 | 0.0020 | <0.0003 | 0.039 | 0.058 | 0.004 |
| 4 | 0.24 | 1.26 | 0.37 | 0.008 | 0.038 | 0.66 | 0.12 | 0.0009 | ≥0.0003 | 0.010 | 0.030 | 0.020 |
| 5 | 0.29 | 0.51 | 0.79 | 0.012 | 0.016 | 0.32 | 0.09 | 0.0048 | ≥0.0003 | 0.010 | 0.094 | 0.013 |
| 6 | 0.22 | 0.62 | 0.25 | 0.013 | 0.049 | 0.98 | 0.26 | 0.0006 | ≥0.0003 | 0.010 | 0.030 | 0.015 |
| 7 | 0.24 | 1.10 | 0.50 | 0.016 | 0.020 | 0.60 | 0.20 | 0.0040 | ≥0.0003 | 0.010 | 0.040 | 0.040 |
| 8 | 0.19 | 0.84 | 0.58 | 0.015 | 0.021 | 1.03 | 0.04 | 0.0032 | ≥0.0003 | 0.010 | 0.039 | 0.035 |
| 9 | 0.17 | 0.95 | 0.33 | 0.010 | 0.016 | 0.69 | 0.28 | 0.0019 | <0.0003 | 0.038 | 0.073 | 0.004 |
| 10 | 0.23 | 1.08 | 0.61 | 0.015 | 0.014 | 0.50 | 0.09 | 0.0028 | ≥0.0003 | 0.010 | 0.018 | 0.010 |
| 11 | 0.15 | 1.48 | 0.23 | 0.016 | 0.016 | 1.18 | 0.06 | 0.0016 | ≥0.0003 | 0.010 | 0.012 | 0.048 |
| 12 | 0.18 | 0.90 | 0.30 | 0.008 | 0.010 | 0.40 | 0.05 | 0.0020 | ≥0.0003 | 0.010 | 0.020 | 0.015 |
| 13 | 0.22 | 1.12 | 0.49 | 0.009 | 0.012 | 0.67 | 0.10 | 0.0020 | ≥0.0003 | 0.010 | 0.029 | 0.025 |
| 14 | 0.20 | 1.00 | 0.41 | 0.010 | 0.009 | 0.48 | 0.18 | 0.0023 | ≥0.0003 | 0.010 | 0.028 | 0.019 |
| 15 | 0.19 | 0.94 | 0.26 | 0.013 | 0.016 | 0.82 | 0.21 | 0.0009 | <0.0003 | 0.040 | 0.059 | 0.009 |
| 16 | 0.23 | 0.83 | 0.55 | 0.018 | 0.024 | 0.93 | 0.05 | 0.0035 | ≥0.0003 | 0.010 | 0.040 | 0.016 |
| 17 | 0.18 | 1.39 | 0.37 | 0.017 | 0.013 | 1.11 | 0.08 | 0.0025 | ≥0.0003 | 0.010 | 0.021 | 0.013 |
| 18 | 0.20 | 1.21 | 0.46 | 0.012 | 0.018 | 0.58 | 0.16 | 0.0007 | <0.0003 | 0.044 | 0.085 | 0.009 |
| 19 | 0.21 | 0.75 | 0.64 | 0.010 | 0.017 | 0.64 | 0.09 | 0.0031 | ≥0.0003 | 0.010 | 0.016 | 0.008 |
| 20 | 0.20 | 0.99 | 0.51 | 0.012 | 0.013 | 0.59 | 0.11 | 0.0027 | ≥0.0003 | 0.010 | 0.029 | 0.012 |
| 21 | 0.22 | 1.31 | 0.63 | 0.013 | 0.015 | 0.48 | 0.04 | 0.0019 | ≥0.0003 | 0.010 | 0.033 | 0.022 |
| 22 | 0.21 | 1.05 | 0.44 | 0.010 | 0.011 | 0.72 | 0.10 | 0.0021 | ≥0.0003 | 0.010 | 0.017 | 0.010 |
| 23 | 0.19 | 0.93 | 0.59 | 0.009 | 0.012 | 0.34 | 0.25 | 0.0025 | ≥0.0003 | 0.010 | 0.025 | 0.016 |
| 24 | 0.24 | 0.88 | 0.48 | 0.015 | 0.016 | 0.65 | 0.09 | 0.0032 | <0.0003 | 0.038 | 0.060 | 0.005 |
| 25 | 0.18 | 1.14 | 0.56 | 0.014 | 0.014 | 0.42 | 0.17 | 0.0029 | ≥0.0003 | 0.010 | 0.036 | 0.010 |
| 26 | 0.20 | 1.00 | 0.62 | 0.012 | 0.012 | 0.53 | 0.12 | 0.0018 | ≥0.0003 | 0.010 | 0.041 | 0.013 |
| 27 | 0.21 | 0.52 | 0.68 | 0.012 | 0.013 | 0.64 | 0.23 | 0.0016 | ≥0.0003 | 0.010 | 0.036 | 0.015 |
| 28 | 0.20 | 0.83 | 0.62 | 0.015 | 0.016 | 0.75 | 0.19 | 0.0018 | ≥0.0003 | 0.010 | 0.030 | 0.012 |
| 29 | 0.22 | 1.09 | 0.67 | 0.014 | 0.018 | 0.61 | 0.21 | 0.0015 | ≥0.0003 | 0.010 | 0.033 | 0.018 |
| 30 | 0.13 | 0.75 | 0.43 | 0.015 | 0.025 | 0.55 | 0.09 | 0.0019 | ≥0.0003 | 0.010 | 0.020 | 0.006 |
| 31 | 0.31 | 1.06 | 0.49 | 0.016 | 0.019 | 0.73 | 0.19 | 0.0039 | ≥0.0003 | 0.010 | 0.036 | 0.025 |
| 32 | 0.20 | 0.49 | 0.62 | 0.013 | 0.015 | 1.15 | 0.04 | 0.0032 | ≥0.0003 | 0.010 | 0.029 | 0.010 |
| 33 | 0.17 | 1.52 | 0.29 | 0.011 | 0.013 | 0.67 | 0.10 | 0.0026 | <0.0003 | 0.038 | 0.072 | 0.006 |
| 34 | 0.18 | 0.60 | 0.18 | 0.014 | 0.016 | 0.40 | 0.21 | 0.0018 | ≥0.0003 | 0.010 | 0.041 | 0.010 |
| 35 | 0.25 | 1.38 | 0.83 | 0.008 | 0.007 | 0.95 | 0.13 | 0.0007 | ≥0.0003 | 0.010 | 0.025 | 0.031 |
| 36 | 0.23 | 0.84 | 0.54 | 0.021 | 0.032 | 0.62 | 0.11 | 0.0020 | ≥0.0003 | 0.010 | 0.046 | 0.005 |
| 37 | 0.19 | 0.97 | 0.69 | 0.014 | 0.052 | 0.55 | 0.08 | 0.0024 | ≥0.0003 | 0.010 | 0.039 | 0.026 |
| 38 | 0.16 | 0.69 | 0.25 | 0.012 | 0.015 | 0.29 | 0.28 | 0.0016 | <0.0003 | 0.040 | 0.068 | 0.009 |
| 39 | 0.27 | 1.27 | 0.71 | 0.011 | 0.012 | 1.22 | 0.05 | 0.0035 | ≥0.0003 | 0.010 | 0.025 | 0.014 |
| 40 | 0.20 | 0.71 | 0.81 | 0.010 | 0.010 | 1.03 | 0.00 | 0.0001 | ≥0.0003 | 0.023 | 0.026 | 0.049 |
| 41 | 0.22 | 0.54 | 0.67 | 0.015 | 0.024 | 1.07 | 0.02 | 0.0011 | <0.0003 | 0.041 | 0.083 | 0.005 |
| 42 | 0.18 | 0.65 | 0.50 | 0.010 | 0.050 | 0.48 | 0.18 | 0.0004 | <0.0003 | 0.038 | 0.039 | 0.016 |
| 43 | 0.19 | 0.77 | 0.41 | 0.010 | 0.018 | 0.59 | 0.15 | 0.0042 | ≥0.0003 | 0.010 | 0.009 | 0.011 |
| 44 | 0.21 | 0.69 | 0.45 | 0.011 | 0.019 | 0.61 | 0.10 | 0.0019 | <0.0003 | 0.038 | 0.035 | 0.005 |
| 45 | 0.20 | 1.05 | 0.36 | 0.017 | 0.022 | 0.73 | 0.22 | 0.0029 | ≥0.0003 | 0.010 | 0.103 | 0.025 |
| 46 | 0.24 | 0.93 | 0.60 | 0.012 | 0.020 | 0.37 | 0.13 | 0.0038 | ≥0.0003 | 0.010 | 0.035 | 0.050 |
| 47 | 0.17 | 0.84 | 0.58 | 0.013 | 0.015 | 0.50 | 0.16 | 0.0021 | <0.0003 | 0.040 | 0.090 | 0.042 |
| 48 | 0.20 | 1.16 | 0.52 | 0.012 | 0.013 | 0.68 | 0.04 | 0.0030 | ≥0.0003 | 0.010 | 0.043 | 0.008 |
| 49 | 0.28 | 0.51 | 0.77 | 0.011 | 0.012 | 0.60 | 0.16 | 0.0005 | <0.0003 | 0.045 | 0.086 | 0.004 |

TABLE 1-continued

| | | | | | | | | | | | | |
|---|---|---|---|---|---|---|---|---|---|---|---|---|
| 50 | 0.22 | 0.53 | 0.64 | 0.009 | 0.014 | 0.95 | 0.06 | 0.0024 | <0.0003 | 0.039 | 0.064 | 0.003 |
| 51 | 0.24 | 0.56 | 0.61 | 0.016 | 0.025 | 0.87 | 0.18 | 0.0023 | <0.0003 | 0.034 | 0.074 | 0.000 |
| 52 | 0.21 | 0.82 | 0.68 | 0.018 | 0.019 | 1.20 | 0.06 | 0.0019 | <0.0003 | 0.033 | 0.059 | 0.000 |

| Steel No. | N | O | Others | Specified Expression (1)*2 | Remarks |
|---|---|---|---|---|---|
| 1 | 0.0048 | 0.0012 | — | 1.14 | Conforming Steel |
| 2 | 0.0051 | 0.0010 | — | 1.58 | |
| 3 | 0.0039 | 0.0009 | — | 1.06 | |
| 4 | 0.0055 | 0.0015 | — | 1.93 | |
| 5 | 0.0060 | 0.0013 | — | 0.50 | |
| 6 | 0.0048 | 0.0012 | — | 0.89 | |
| 7 | 0.0070 | 0.0015 | — | 1.73 | |
| 8 | 0.0072 | 0.0010 | — | 0.77 | |
| 9 | 0.0035 | 0.0008 | — | 1.62 | |
| 10 | 0.0031 | 0.0011 | — | 1.52 | |
| 11 | 0.0114 | 0.0012 | — | 2.05 | |
| 12 | 0.0040 | 0.0008 | — | 1.35 | |
| 13 | 0.0064 | 0.0024 | — | 1.59 | |
| 14 | 0.0052 | 0.0010 | — | 1.63 | |
| 15 | 0.0044 | 0.0015 | — | 1.47 | |
| 16 | 0.0053 | 0.0016 | — | 0.83 | |
| 17 | 0.0038 | 0.0011 | Nb: 0.024 | 1.88 | |
| 18 | 0.0064 | 0.0018 | V: 0.022 | 1.90 | |
| 19 | 0.0032 | 0.0010 | Sb: 0.015 | 0.85 | |
| 20 | 0.0051 | 0.0011 | Cu: 0.24 | 1.40 | |
| 21 | 0.0065 | 0.0010 | Ni: 0.18 | 1.86 | |
| 22 | 0.0048 | 0.0013 | Ca: 0.0015 | 1.46 | |
| 23 | 0.0060 | 0.0009 | Sn: 0.014 | 1.58 | |
| 24 | 0.0055 | 0.0008 | Se: 0.028 | 1.15 | |
| 25 | 0.0036 | 0.0012 | Ta: 0.033 | 1.82 | |
| 26 | 0.0040 | 0.0010 | Hf: 0.009 | 1.41 | |
| 27 | 0.0042 | 0.0013 | — | 0.62 | |
| 28 | 0.0051 | 0.0011 | — | 1.09 | |
| 29 | 0.0049 | 0.0120 | — | 1.64 | |
| 30 | 0.0029 | 0.0013 | — | 1.00 | Comparative Steel |
| 31 | 0.0048 | 0.0010 | — | 1.58 | |
| 32 | 0.0059 | 0.0018 | — | 0.06 | |
| 33 | 0.0050 | 0.0015 | — | 2.41 | |
| 34 | 0.0045 | 0.0013 | — | 1.11 | |
| 35 | 0.0067 | 0.0009 | — | 1.79 | |
| 36 | 0.0034 | 0.0016 | — | 1.10 | |
| 37 | 0.0071 | 0.0013 | — | 1.25 | |
| 38 | 0.0052 | 0.0012 | — | 1.39 | |
| 39 | 0.0046 | 0.0011 | — | 1.40 | |
| 40 | 0.0065 | 0.0010 | Nb: 0.103 | 0.36 | |
| 41 | 0.0041 | 0.0009 | — | 0.13 | |
| 42 | 0.0050 | 0.0014 | — | 0.95 | |
| 43 | 0.0058 | 0.0012 | — | 1.11 | |
| 44 | 0.0036 | 0.0011 | — | 0.86 | |
| 45 | 0.0084 | 0.0019 | — | 1.68 | |
| 46 | 0.0150 | 0.0015 | — | 1.38 | |
| 47 | 0.0155 | 0.0012 | — | 1.21 | |
| 48 | 0.0052 | 0.0026 | — | 1.55 | |
| 49 | 0.0054 | 0.0014 | — | 0.47 | |
| 50 | 0.0044 | 0.0015 | — | 0.25 | |
| 51 | 0.0055 | 0.0019 | — | 0.54 | |
| 52 | 0.0046 | 0.0023 | — | 0.63 | |

*1 Underlined if outside the appropriate range.

*2 1.8 * [% Si] + 1.5 * [% Mo] − ([% Mn] + [% Cr])/2

*3 If B − [10.8/14(N − (14/48)Ti)] ≥ 0.0003%, then 0.010%. If B − [10.8/14(N − (14/48)Ti)] < 0.0003%, then 27/14[N − (14/48)Ti − (14/10.8)B + 0.015].

*4 B − [10.8/14(N − (14/48)Ti)]

TABLE 2

| Test No. | Steel No. | (Si − Sf)/Si | √I (μm) | Rotating bending fatigue test Minimum fatigue life (times) | 1 × 10³ times impact fatigue strength (J) | Remarks |
|---|---|---|---|---|---|---|
| 1 | 1 | 0.9824 | 43 | $7.5 \times 10^5$ | 4.3 | Example |
| 2 | 2 | 0.9905 | 38 | $6.2 \times 10^5$ | 4.5 | |
| 3 | 3 | 0.9748 | 65 | $4.6 \times 10^5$ | 4.1 | |
| 4 | 4 | 0.9932 | 31 | $1.3 \times 10^6$ | 3.7 | |
| 5 | 5 | 0.9901 | 29 | $1.6 \times 10^6$ | 3.6 | |

TABLE 2-continued

| Test No. | Steel No. | (Si − Sf)/Si | √I (μm) | Rotating bending fatigue test Minimum fatigue life (times) | $1 \times 10^3$ times impact fatigue strength (J) | Remarks |
|---|---|---|---|---|---|---|
| 6 | 6 | 0.9863 | 40 | $8.9 \times 10^5$ | 3.5 | |
| 7 | 7 | 0.9912 | 36 | $1.0 \times 10^6$ | 4.1 | |
| 8 | 8 | 0.9920 | 30 | $1.5 \times 10^6$ | 4.2 | |
| 9 | 9 | 0.9814 | 46 | $9.0 \times 10^5$ | 3.9 | |
| 10 | 10 | 0.9952 | 24 | $1.4 \times 10^6$ | 3.8 | |
| 11 | 11 | 0.9624 | 66 | $3.8 \times 10^5$ | 3.7 | |
| 12 | 12 | 0.9905 | 30 | $7.1 \times 10^5$ | 3.6 | |
| 13 | 13 | 0.9854 | 31 | $9.2 \times 10^5$ | 4.1 | |
| 14 | 14 | 0.9926 | 53 | $6.7 \times 10^5$ | 3.9 | |
| 15 | 15 | 0.9897 | 49 | $5.6 \times 10^5$ | 3.8 | |
| 16 | 16 | 0.9900 | 46 | $6.2 \times 10^5$ | 4.0 | |
| 17 | 17 | 0.9879 | 34 | $1.8 \times 10^6$ | 3.5 | |
| 18 | 18 | 0.9818 | 70 | $4.0 \times 10^5$ | 4.1 | |
| 19 | 19 | 0.9912 | 55 | $7.7 \times 10^5$ | 3.9 | |
| 20 | 20 | 0.9862 | 48 | $6.4 \times 10^5$ | 4.0 | |
| 21 | 21 | 0.9897 | 50 | $8.1 \times 10^5$ | 4.4 | |
| 22 | 22 | 0.9873 | 71 | $4.0 \times 10^5$ | 3.5 | |
| 23 | 23 | 0.9925 | 32 | $9.2 \times 10^5$ | 3.8 | |
| 24 | 24 | 0.9858 | 40 | $6.8 \times 10^5$ | 3.6 | |
| 25 | 25 | 0.9920 | 28 | $1.1 \times 10^6$ | 4.0 | |
| 26 | 26 | 0.9895 | 45 | $7.3 \times 10^5$ | 3.9 | |
| 27 | 27 | 0.9862 | 65 | $6.8 \times 10^5$ | 3.8 | |
| 28 | 28 | 0.9824 | 45 | $7.1 \times 10^5$ | 4.1 | |
| 29 | 29 | 0.9873 | 51 | $8.2 \times 10^5$ | 4.3 | |
| 30 | 30 | 0.9941 | 30 | $1.4 \times 10^4$ | 2.9 | Comparative Example |
| 31 | 31 | 0.9624 | 78 | $6.5 \times 10^4$ | 3.1 | |
| 32 | 32 | 0.9765 | 64 | $2.3 \times 10^5$ | 2.7 | |
| 33 | 33 | 0.9792 | 36 | $2.0 \times 10^5$ | 3.2 | |
| 34 | 34 | 0.9919 | 27 | $9.9 \times 10^4$ | 3.3 | |
| 35 | 35 | 0.9819 | 45 | $8.4 \times 10^4$ | 3.0 | |
| 36 | 36 | 0.9891 | 51 | $2.0 \times 10^5$ | 2.6 | |
| 37 | 37 | 0.9912 | 33 | $5.5 \times 10^4$ | 3.1 | |
| 38 | 38 | 0.9639 | 60 | $2.0 \times 10^5$ | 3.3 | |
| 39 | 39 | 0.9743 | 49 | $1.1 \times 10^5$ | 3.0 | |
| 40 | 40 | 0.9895 | 40 | $5.0 \times 10^4$ | 2.3 | |
| 41 | 41 | 0.9878 | 37 | $2.3 \times 10^4$ | 2.5 | |
| 42 | 42 | 0.9814 | 40 | $4.6 \times 10^4$ | 2.4 | |
| 43 | 43 | 0.9920 | 28 | $6.6 \times 10^4$ | 3.2 | |
| 44 | 44 | 0.9912 | 49 | $3.0 \times 10^4$ | 2.5 | |
| 45 | 45 | 0.9932 | 21 | $5.7 \times 10^4$ | 2.2 | |
| 46 | 46 | 0.9840 | 46 | $7.5 \times 10^4$ | 2.5 | |
| 47 | 47 | 0.9624 | 73 | $3.3 \times 10^4$ | 2.7 | |
| 48 | 48 | 0.9748 | 115 | $1.1 \times 10^4$ | 2.5 | |
| 49 | 49 | 0.9932 | 42 | $2.4 \times 10^5$ | 3.0 | |
| 50 | 50 | 0.9905 | 36 | $1.8 \times 10^5$ | 2.6 | |
| 51 | 14 | 0.9588 | 92 | $6.2 \times 10^4$ | 3.1 | |
| 52 | 51 | 0.9832 | 61 | $8.3 \times 10^4$ | 2.9 | |
| 53 | 52 | 0.9871 | 54 | $7.3 \times 10^4$ | 3.2 | |

*1 Underlined if outside the appropriate range.

INDUSTRIAL APPLICABILITY

According to the present disclosure, it is possible to provide a case hardening steel suitable as a material for producing mechanical structural parts having high rotating bending fatigue strength and high impact fatigue strength at a relatively low cost, and a method of producing the same.

The invention claimed is:

1. A case hardening steel comprising a chemical composition containing, by mass %, C: 0.15% or more and 0.30% or less, Si: 0.50% or more and 1.50% or less, Mn: 0.20% or more and 0.80% or less, P: 0.003% or more and 0.020% or less, S: 0.005% or more and 0.050% or less, Cr: 0.30% or more and 1.20% or less, Mo: 0.03% or more and 0.30% or less, B: 0.0005% or more and 0.0050% or less, Ti: 0.002% or more and less than 0.050%, N: 0.0020% or more and 0.0150% or less, and O: 0.0003% or more and 0.0025% or less, within a range satisfying Expression (1):

$$1.8*[\%\ Si]+1.5*[\%\ Mo]-([\%\ Mn]+[\%\ Cr])/2 \geq 0.50 \quad (1),$$

and

Al in an amount satisfying the following relations:

if $[\%\ B]-[(10.8/14)*\{[\%\ N]-(14/48)[\%\ Ti]\}] \geq 0.0003\%$, then $0.010\%\ [\%\ Al] \leq 0.100\%$, and if $[\%\ B]-[(10.8/14)*\{[\%\ N]-(14/48)[\%\ Ti]\}] < 0.0003\%$, then $(27/14)*\{[\%\ N]-(14/48)[\%\ Ti]-(14/10.8)[\%\ B]+0.02\} \leq [\%\ Al] \leq 0.100\%$, with the balance being Fe and inevitable impurities, where [% M] represents the content by mass % of M element, wherein the following Expression (2) is satisfied:

$$\sqrt{I} \leq 80 \quad (2)$$

where I represents an area in $\mu m^2$ of an oxide-based inclusion located at the center of a fish-eye on a fracture surface of a test piece of the case hardening steel after being subjected to carburizing-quenching and tempering and subsequently to a Ono-type rotating bending fatigue test, wherein the test piece is sampled from a position of half the diameter parallel to the stretching direction for hot working, and the test piece is subjected to the carburizing-quenching comprising holding the test piece at 930° C. for 180 minutes, and cooling the test piece to 850° C. in a furnace, and holding the test piece at 850° C. for 40 minutes, and subjecting the test piece to carburizing treatment, and oil quenching the test piece, and then the test piece is subjected to the tempering comprising holding the test piece after the carburizing-quenching at 170° C. for 60 minutes, and then surface of the test piece is polished 0.1 mm, and then the test piece is subjected to the Ono-type rotating bending fatigue test where load stress is 1000 MPa, and rotational speed is 3500 rpm.

2. The case hardening steel according to claim 1, wherein the chemical composition further contains at least one group selected from the following (A) to (C);

(A) by mass %, one or more selected from the group consisting of Nb: 0.050% or less, V: 0.050% or less, and Sb: 0.035% or less;

(B) by mass %, at least one selected from the group consisting of Cu: 1.0% or less and Ni: 1.0% or less;

(C) by mass %, at least one selected from the group consisting of Ca: 0.0050% or less, Sn: 0.50% or less, Se: 0.30% or less, Ta: 0.10% or less, and Hf: 0.10% or less.

3. A method of producing the case hardening steel according to claim 1, comprising:

subjecting a cast steel to hot working by at least one of hot forging or hot rolling with a reduction in area satisfying Expression (3):

$$(S1-S2)/S1 \geq 0.960 \quad (3)$$

to thereby obtain a case hardening steel as a steel bar or a wire rod, the cast steel comprising a chemical composition containing, by mass %, C: 0.15% or more and 0.30% or less, Si: 0.50% or more and 1.50% or less, Mn: 0.20% or more and 0.80% or less, P: 0.003% or more and 0.020% or less, S: 0.005% or more and 0.050% or less, Cr: 0.30% or more and 1.20% or less, Mo: 0.03% or more and 0.30% or less, B: 0.0005% or more and 0.0050% or less, Ti: 0.002% or more and less than 0.050%, N: 0.0020% or more and 0.0150% or less, and O: 0.0003% or more and 0.0025% or less, within a range satisfying Expression (1):

$$1.8*[\%\ Si]+1.5*[\%\ Mo]-([\%\ Mn]+[\%\ Cr])/2 \geq 0.50 \quad (1)$$

and

Al in an amount satisfying the following relations:

if $[\%\ B]-[(10.8/14)*\{[\%\ N]-(14/48)[\%\ Ti]\}] \geq 0.0003\%$, then $0.010\% \leq [\%\ Al] \leq 0.100\%$, and if $[\%\ B]-[(10.8/14)*\{[\%\ N]-(14/48)[\%\ Ti]\}] < 0.0003\%$, then $(27/14)*\{[\%\ N]-(14/48)[\%\ Ti]-(14/10.8)[\%\ B]+0.02\} \leq [\%\ Al] \leq 0.100\%$, with the balance being Fe and inevitable impurities, where [% M] represents the content by mass % of M element, S1 represents a sectional area in $mm^2$ of the cast steel in a cross section orthogonal to a stretching direction in the hot working, and S2 represents a sectional area in $mm^2$ of the steel bar or the wire rod in a cross section orthogonal to the stretching direction in the hot working.

4. The case hardening steel according to claim 3, wherein the chemical composition further contains at least one group selected from the following (A) to (C);

(A) by mass %, one or more selected from the group consisting of Nb: 0.050% or less, V: 0.050% or less, and Sb: 0.035% or less;

(B) by mass %, at least one selected from the group consisting of Cu: 1.0% or less and Ni: 1.0% or less;

(C) by mass %, at least one selected from the group consisting of Ca: 0.0050% or less, Sn: 0.50% or less, Se: 0.30% or less, Ta: 0.10% or less, and Hf: 0.10% or less.

5. A method of producing a gear part, comprising:

subjecting the case hardening steel as recited in claim 1 to either machining or forging and subsequent machining to give a gear shape; and then subjecting the case hardening steel to carburizing-quenching and tempering to obtain a gear part.

6. A method of producing a gear part, comprising:

in addition to the method steps as recited in claim 3, subjecting the case hardening steel to either machining or forging and subsequent machining to give a gear shape; and then subjecting the case hardening steel to carburizing-quenching and tempering to obtain a gear part.

7. A method of producing a gear part, comprising:

subjecting the case hardening steel as recited in claim 2 to either machining or forging and subsequent machining to give a gear shape; and then subjecting the case hardening steel to carburizing-quenching and tempering to obtain a gear part.

8. A method of producing a gear part, comprising:

in addition to the method steps as recited in claim 4, subjecting the case hardening steel to either machining or forging and subsequent machining to give a gear shape; and then subjecting the case hardening steel to carburizing-quenching and tempering to obtain a gear part.

9. The case hardening steel according to claim 1, wherein the chemical composition contains Si: 1.02% or more and 1.50% or less.

10. The case hardening steel according to claim 1, wherein the chemical composition contains Ti: 0.002% or more and 0.025% or less.

* * * * *